United States Patent [19]

Donovan et al.

[11] Patent Number: 4,635,734

[45] Date of Patent: Jan. 13, 1987

[54] BOOSTERLESS PERFORATING GUN AND METHOD OF ASSEMBLY

[75] Inventors: Joseph F. Donovan, Tomball; Gregg W. Stout, Montgomery; Phillip W. Schmuck, Spring, all of Tex.

[73] Assignee: Baker Oil Tools, Inc., Houston, Tex.

[21] Appl. No.: 743,578

[22] Filed: Jun. 11, 1985

[51] Int. Cl.[4] ..... E21B 43/117

[52] U.S. Cl. ..... 175/4.6; 175/4.55; 102/312; 102/318

[58] Field of Search ..... 166/297; 175/4.55, 4.56, 175/4.6; 89/1.15; 102/312, 318, 322

[56] References Cited

U.S. PATENT DOCUMENTS

| | | | |
|---|---|---|---|
| 2,831,429 | 4/1958 | Moore | 89/1.15 |
| 2,935,020 | 5/1960 | Howard et al. | 175/4.6 |
| 2,968,243 | 1/1961 | Turechek | 175/4.6 |
| 3,128,702 | 4/1964 | Christopher | 175/4.6 |
| 3,245,485 | 4/1966 | Bell | 175/4.6 |
| 3,860,865 | 1/1975 | Stroud et al. | 89/1.15 X |
| 4,140,188 | 2/1979 | Vann | 175/4.51 |
| 4,292,895 | 10/1981 | Bell et al. | 102/318 X |
| 4,481,884 | 11/1984 | Yunan | 102/312 X |
| 4,523,649 | 6/1985 | Stout | 175/4.6 |
| 4,543,703 | 10/1985 | Wetzel et al. | 175/4.6 X |
| 4,564,076 | 1/1986 | Vann et al. | 175/4.52 |

FOREIGN PATENT DOCUMENTS

| | | | |
|---|---|---|---|
| 258201 | 10/1970 | U.S.S.R. | 175/4.55 |

*Primary Examiner*—James A. Leppink
*Assistant Examiner*—William P. Neuder
*Attorney, Agent, or Firm*—Norvell & Associates

[57] ABSTRACT

A method and apparatus for effecting the assembly and arming a multisection perforating gun for a subterranean well. Each of the gun sections has a plurality of vertically and angularly spaced shaped charge containers disposed with the primer ends located in concentric fashion about the vertical axis of the gun, thus defining an axial passage communicating with the bores of hollow nipples which respectively effect securement of one gun section to the next adjacent gun section. In one modification, a continuous primer cord is stored on a reel below the lowermost gun section and is then pulled successively upwardly through each of the additional gun sections as they are assembled. In another modification, each of the gun sections is provided with a length of fusible guide tubing interposed between the inner primer ends of all of such shaped charges and the continuous length of primer cord is fed downwardly through the axial passage defined by such guide tubing. During assembly of the gun sections, they may be successively lowered into the well so that when assembly is complete, all of the shaped charges are below the well surface before the gun is armed by the attachment of the primer cord to a booster charge.

13 Claims, 10 Drawing Figures

BOOSTERLESS PERFORATING GUN AND METHOD OF ASSEMBLY

CROSS-REFERENCE TO RELATED APPLICATION

This application is related in subject matter to: U.S. patent application Ser. No. 743,580, entitled "Method and Apparatus for Initiating Subterranean Well Perforating Gun Firing from Bottom to Top"; U.S. patent application Ser. No. 743,429, entitled "Perforating Gun for Initiation of Shooting from Bottom to Top"; and U.S. patent application Ser. No. 743,579, entitled "Method and Apparatus for Firing Multisection Perforating Guns".

BACKGROUND OF THE INVENTION

1. Field of the Invention

The invention relates to perforating guns employed for perforating the casing and adjoining production formation of a subterranean well, and to methods for assembling and arming such gun in a manner that minimizes the risk of injury to the persons doing the assembly.

2. History of the Prior Art

The utilization of a plurality of vertically and angularly spaced shaped charges to effect the perforation of a subterranean well represents the modern approach to achieving perforation of the casing and the adjoining production formation. Such shaped charges are substantially concurrently fired by the ignition of a primer cord which passes successively past the primer ends of each of the shaped charge containers. It is not uncommon for the zone to be perforated to extend from ten to one thousand feet in length, thus necessitating the fabrication of the perforating gun as a plurality of axially stacked, substantially identical gun sections. The transmission of the firing energy from the uppermost section to the lowermost section is commonly accomplished through the mounting of booster charges on each of the ends of a primer cord which is utilized only within an individual gun section. The booster charges are required to insure that sufficient energy is transmitted from one primer cord to the next to insure a successive ignition of all primer cords. There have been many instances of unsuccessful transfer of ignition energy from one gun section to the next, necessitating the removal of the apparatus from the well.

As is well known to those skilled in the art, the booster charges commonly employed contain lead azide, an explosive which is extremely sensitive and susceptible to detonation by a relatively low level impact or shock. It is sufficiently dangerous that the assembly of perforating guns containing lead azide boosters at the factory is prohibited, due to regulations preventing the transport of such guns containing lead azide boosters on the public highways or on maritime carriers. It thus becomes necessary to insert the lead azide boosters in the perforating gun at the well site and, in this environment, it is readily possible to prematurely detonate the lead azide booster charges with the consequent high risk of injury to personnel effecting the assembly and arming of the multisection perforating gun.

In contrast, the primer cord commonly employed in perforating guns to effect the ignition of the shaped charges is relatively insensitive to inadvertent shock detonation and requires a substantial degree of heat to effect its ignition. Thus, a perforating gun construction which permits the firing of all of the shaped charges, regardless of the number of gun sections, by a single continuous length of primer cord, would obviously represent a substantial advantage for the industry.

SUMMARY OF THE INVENTION

The invention contemplates mounting the required number of shaped charge containers in vertically and angularly spaced apertures provided in the wall of a tubular carrier. If the vertical extent of the zone to be perforated is in excess of about ten feet, then a plurality of axially stacked perforating gun sections are employed, with each section comprising an apertured tubular carrier which may be interconnected in axially stacked relationship by hollow nipples.

The shaped charge containers are assembled in wall apertures of the tubular carrier or housing with the inner or primer ends of such shaped charge containers disposed in close proximity to the axis of the carrier, yet providing sufficient space to permit a length of primer cord to be readily inserted between the juxtapositioned ends of the shaped charge containers.

In accordance with a preferred modification of the invention, a continuous strand or primer cord having a length at least equal to the total length of the plurality of gun sections to be assembled at the well site, is wound on a hollow reel mounted in a housing which can be assembled to the bottom of the lowermost gun section with the axis of the hollow reel disposed in a vertical position so the primer cord can be prewound to freely unwind as it is pulled to the top. A detachable connector having a hook engaging eye or some similar form of detachable connection, is then crimped onto the upper free end of the primer cord for pulling by a suitable cable through the superimposed gun section. Preferably, each gun section is provided at the factory with a length of metal or plastic cord or cable, extending axially through the center of the gun section and having a hook or some similar form of detachable connection secured to each projecting end of the cable, one end being detachably connectable to the primer cord and the other end being connectable to a suitable hoist or pulling mechanism provided on the drilling rig.

The reel containing housing is vertically positioned on the floor of the drilling rig and the lowermost perforating gun section is then suspended above the reel housing. The bottom projecting end of the cable traversing the lowermost gun section is connected to the detachable connection on the end of the primer cord and the lowermost gun section is connected. Then the cable or cord is pulled upwardly to pull a length of the primer cord off the reel and upwardly through the lowermost gun section. The reel housing and the lowermost gun section may be partially lowered into the well opening. The cable removed from the lowermost gun section is disconnected from the primer cord and the free end of the primer cord is suitably secured.

The next gun section is then positioned in vertical alignment with the lowermost gun section and the bottom projecting end of the pull cable of such gun section is connected to the connector provided on the end of the primer cord and the guns are connected. Then the perforating cord is pulled by such cable through the next gun section to the lowermost gun section. The assembly operation proceeds in similar fashion until the required number of gun sections have been assembled and at that point, the top end of the primer cord is secured in conventional manner to a booster charge forming part of a detonating or firing mechanism.

The firing mechanism contains a primer charge which is detonatable by impact or electric means in conventional fashion. Such a detonation of the primer charge, when the gun assembly is properly positioned within the well, will effect the detonation of the booster charge and the detonation of the top end of the primer cord. The detonating shock wave produced by the primer cord travels downwardly through all of the assembled gun sections in close proximity to the inner or primer ends of the shaped charge containers mounted in each gun section, and thus all such shaped charge containers are detonated.

If it is desired to fire the perforating gun from the bottom up in the manner described and claimed in copending application Ser. No. 743,580, filed concurrently herewith and assigned to the Assignee of this application, then the top end of the primer cord is not provided with a booster charge and is isolated from the detonation effects of the primer charge. Instead, a detonation or flame-transmitting tube is ignited by the detonation of the primer charge and this tube, which can be secured to the primer cord and pulled through the gun assemblies concurrently with the primer cord, transmits a flame downwardly to the lowermost end of the primer cord where it ignites a booster charge connected to the primer cord, thus detonating the primer cord at the bottom and such detonation travels upwardly to successively detonate the shaped charge containers of each of the gun sections disposed above the bottom of the gun.

In another embodiment of this invention, each tubular carrier is additionally provided with a relatively small diameter fusible guide tubing which is coaxially disposed within the carrier and has a bore sufficiently large to freely accommodate a primer cord therein.

The shaped charge containers are then assembled in the wall apertures of the tubular carrier or carriers with the inner or primer ends of such shaped charge containers disposed in closed proximity to the exterior wall of the fusible guide tubing. This entire operation can be accomplished at the well site, and, as each horizontal array of shaped charge containers is assembled in the respective carrier, the carrier is then lowered into the well so as to dispose the assembled shaped charges below the well surface even prior to arming of the perforating gun. When all of the shaped charges are assembled in the perforating gun sections, the gun is lowered so that all such shaped charges are disposed below the well surface. A single continuous length of primer cord is then inserted coaxially through the axially stacked tubular carriers, passing through the bore of the aligned lengths of small diameter fusible guide tubing. A single booster charge is then connected to the top end of the continuous length of primer cord and this booster charge is in turn assembled in conventional fashion beneath a firing mechanism containing a primer charge.

The entire gun, together with any related equipment, such as screens, packer and/or gravel pack apparatus, is then lowered into the well so as to position the perforating gun adjacent the zone to be perforated. The actuation of the firing mechanism in any conventional manner, such as by dropping a detonating bar through the bore of the tubular string carrying the perforating gun into the well, will effect the ignition of the primer charge which in turn will ignite the booster charge and in turn ignite the primer cord. The heat and shock wave developed by the ignited continuous primer cord passes rapidly down the entire perforating gun assembly and is sufficiently intense as to melt and fragment the fusible guide tubing within which the primer cord is inserted. This permits the heat of the detonating primer cord to be applied directly to the primer ends of the shaped charge containers and effect their discharge in conventional fashion.

Thus, the assembly and firing of a perforating gun embodying this invention is accomplished in a more efficient manner, which also provides a much higher degree of safety for the well personnel than has heretofore been possible.

Further advantages of the invention will be readily apparent to those skilled in the art from the following detailed description, taken in conjunction with the annexed sheets of drawings, on which are shown two preferred embodiments of the invention.

DESCRIPTION OF THE PREFERRED EMBODIMENTS

Figure 1A:
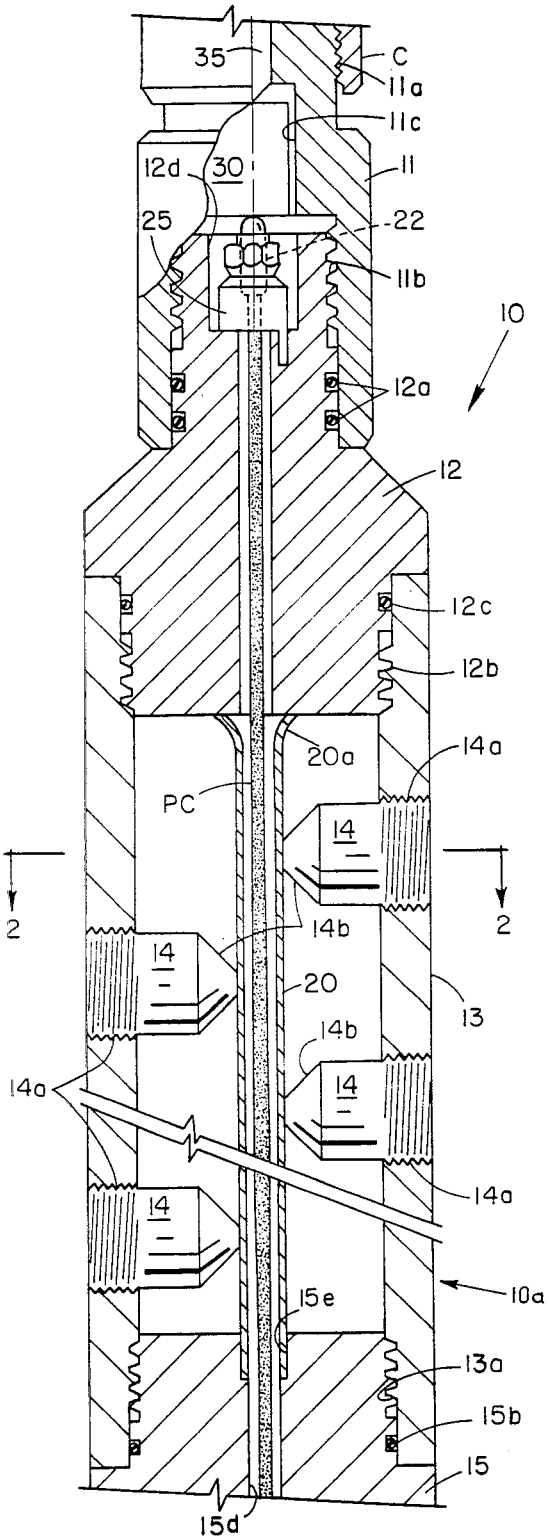
FIGS. 1A and 1B collectively represent a schematic, vertical sectional view of a multisection perforating gun embodying this invention.
Figure 1B:
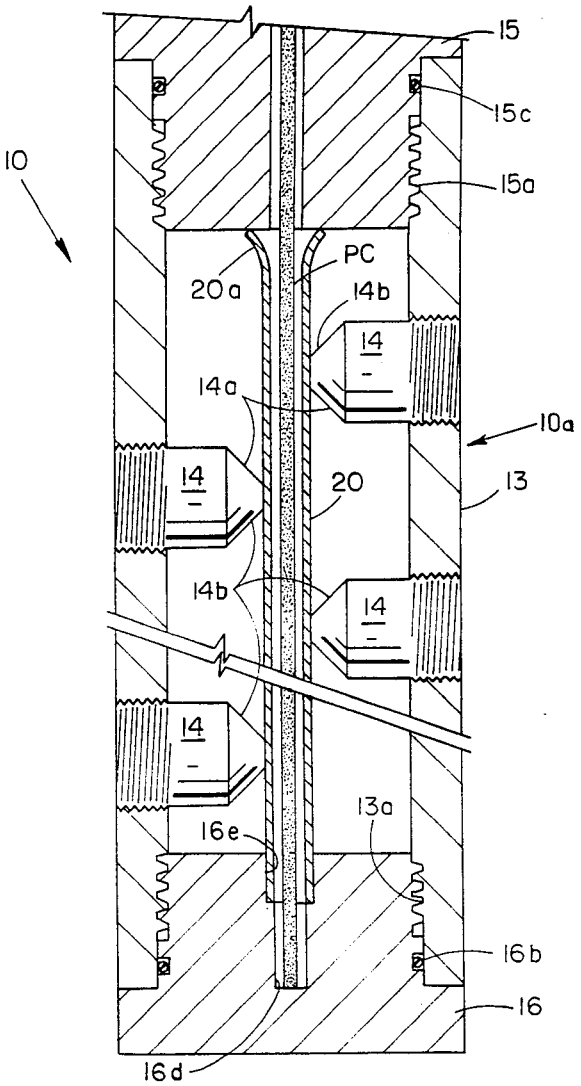

Referring to FIGS. 1A and 1B, there is shown an assembled, multisection perforating gun 10 which is of entirely conventional construction except for the interrelationship of the primer cord PC with the plurality of shaped charge containers 14. As is conventional, the perforating gun terminates at its upper end in a firing head 11 which is threadably connected by external threads **11*a* to the lower end of a well conduit C. Internal threads 11*b* are provided at the lower end of the firing head 11 for connection to a booster chamber sub 12. O-rings 12*a* sealably secure this threaded connection. Booster sub 12 is in turn connected by external threads 12*b* to a cylindrical housing 13 within which, or upon which, a plurality of shaped charge containers 14 are positioned. O-ring seals 12*c* effect the sealing of this threaded connection. In the modification illustrated in FIGS. 1A and 1B, the shaped charge containers 14 are mounted in the wall of the housing 13** in vertically and angularly spaced arrays by being inserted through appropriately spaced apertures in such wall.

The manner of securement of the shaped charge containers 14 in the wall of the housing 13 is immaterial to the practice of this invention and hence, in FIGS. 1A and 1B, a threaded connection **14*a* is shown for each of the shaped charge containers 14**.

The shaped charge containers 14 are of conventional configuration having their conically shaped, primer containing ends 14*b* disposed inwardly and at approximately equal radial distances from the axis of the tubular housing 13.

The bottom end of each tubular housing 13 is threadably secured by internal threads 13*a* to a hollow nipple 15 and the lower end of the nipple 15 is provided with external threads 15*a* for threadably securing the top end of the tubular housing 13 of the next gun section. O-rings 15*b* and 15*c* seal these connections. Obviously, any desired number of gun sections 10*a* may thus be conveniently secured in axially stacked relationship and the lowermost or last gun section, illustrated in FIG. 1B, has a solid plug element 16 engaged with the internal threads 13*a* provided in the bottom of the lowermost tubular housing 13. O-ring 16*b* seals this connection.

The bore 15*d* of each hollow nipple 15 is provided at its upper end with a short counter bore 15*e* and this counter bore mounts a length of guide tubing 20 in co-axial relationship with respect of the axis to the tubular housing 13. The tubing 20 is fabricated from a relatively rigid fusible material, such as aluminum, or any readily fusible, relatively rigid thermoplastic. The length of each tubing 20 corresponds to the spacing between the nipple 15 and the booster sub 12, in the case of the uppermost gun section, and between the nipples 15 in the case of all of the intermediate gun sections. In the bottom gun section, the guide tubing 20 fits in a counterbore 16*e* provided in hole 16*d* in plug 16, and flared upper end 20*a* is adjacent the lowermost nipple 15. The upper end 20*a* of each of the fusible guide tubings 20 is preferably outwardly flared for a purpose to be hereinafter described.

When it is desired to assemble a multisection perforating gun 10 having length dimensions up to two thousand feet, it is readily apparent that the gun must be assembled at the well site and furthermore, assembled from the bottom up, with the lowermost sections of the gun being inserted into the well bore and then moved successively downwardly as the assembly of each gun section proceeds. Thus, each gun section may have the lower end of its tubular housing 13 connected to the threads on the upper end of the adjacent lower nipple 15. The shaped charge containers 14 may be assembled in the housing 13, either at the factory or at the well site, but in either event, there is little danger involved in such an assembly operation since the shaped charge containers are not susceptible to detonation by shock or impact. In any event, when the assembly is completed, and the desired length of perforating gun achieved, all of the assembled gun may be lowered into the well so that all of the shaped charge containers 14 are disposed below the surface.

In accordance with this invention, the gun 10 is then armed through the simple expedient of lowering or pulling up a continuous length of primer cord PC through the aligned bores 12*d* of the booster sub 12, the bore 20*b* of the uppermost fusible guide tube 20, the bore of the uppermost hollow nipple 15 and then successively through the bores of the fusible tubes 20 and hollow nipples 15 until the primer cord is disposed adjacent all of the shaped charge containers 14 incorporated in the multisection gun. The flared upper end 20*a* of each guide tube 20 facilitates the insertion of the primer cord.

A single booster charge 22 is then assembled to the top end of the continuous primer cord PC. Any conventional connecting mechanism may be employed. Such connector device 25 is disposed in an enlarged counter bore 12*d* provided at the upper end of the booster chamber sub 12. A detonatable primer charge 30 is suitably mounted in the bottom opening counter bore 11*c* provided in the firing head 11 and is arranged to be discharged in conventional fashion by the dropping of a detonating bar (not shown) on a firing pin 35. Obviously, electrical ignition could be employed, or the firing pin 35 could be hydraulically actuated.

In any event, the ignition of the primer charge 30 effects the ignition of the booster charge 22 contained in the connecting device 25 and effects the ignition of the primer cord PC. As is well known in the art, the primer cord PC detonates with the detonation wave travelling rapidly down its length and generating sufficient heat and shock energy to immediately fuse and disintegrate the thin-walled fusible guide tubes 20 and effect the ignition of the shaped charges contained in the shaped charge containers 14.

Figure 4:
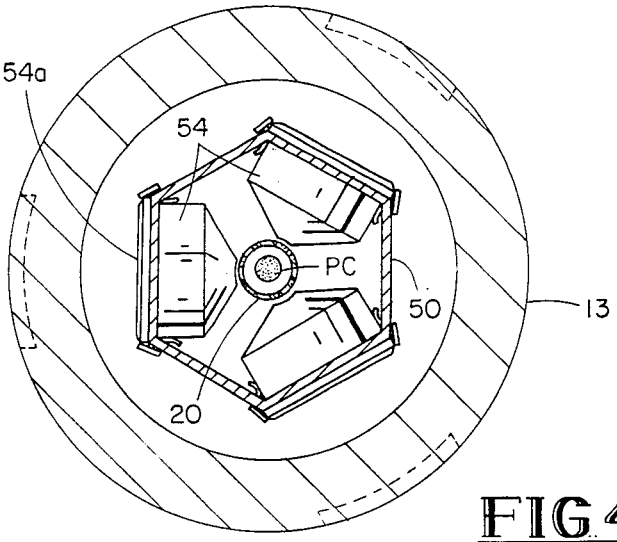
FIG. 4 is a sectional view taken on the plane 4—4 of FIG. 3A.
Figure 3A:
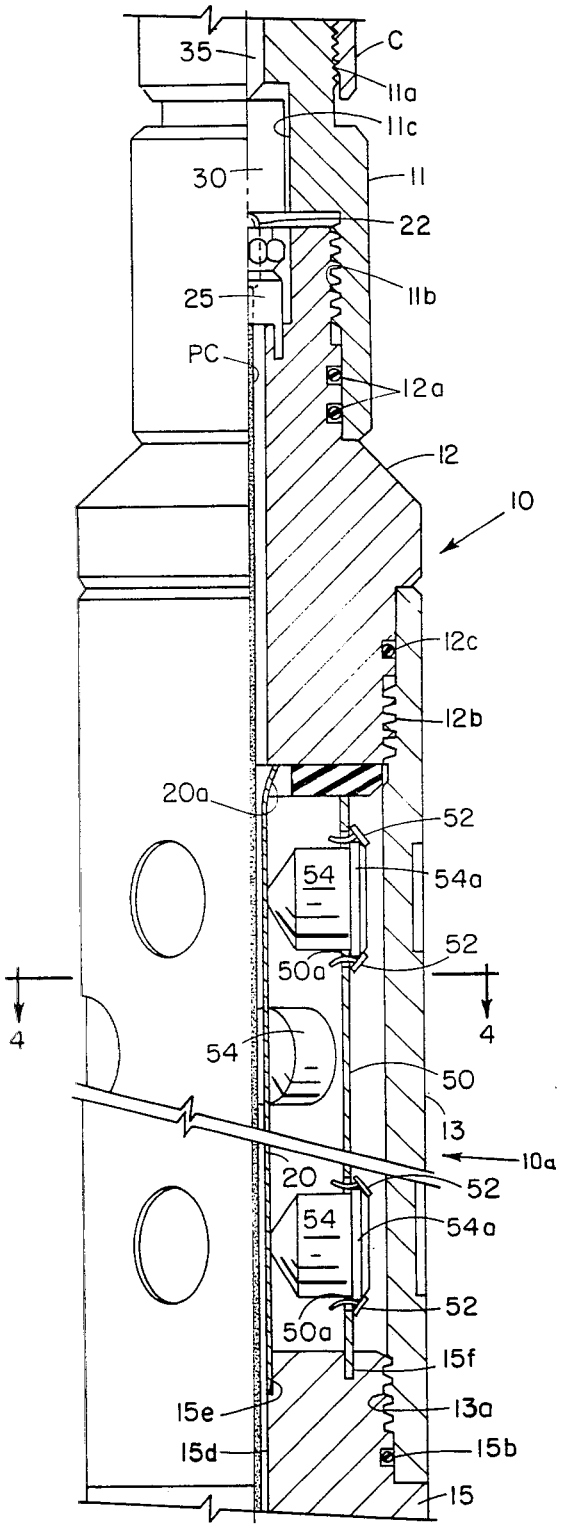
FIGS. 3A and 3B collectively represent a schematic, vertical, quarter-sectional view of a modified form of perforating gun embodying this invention.
Figure 3B:
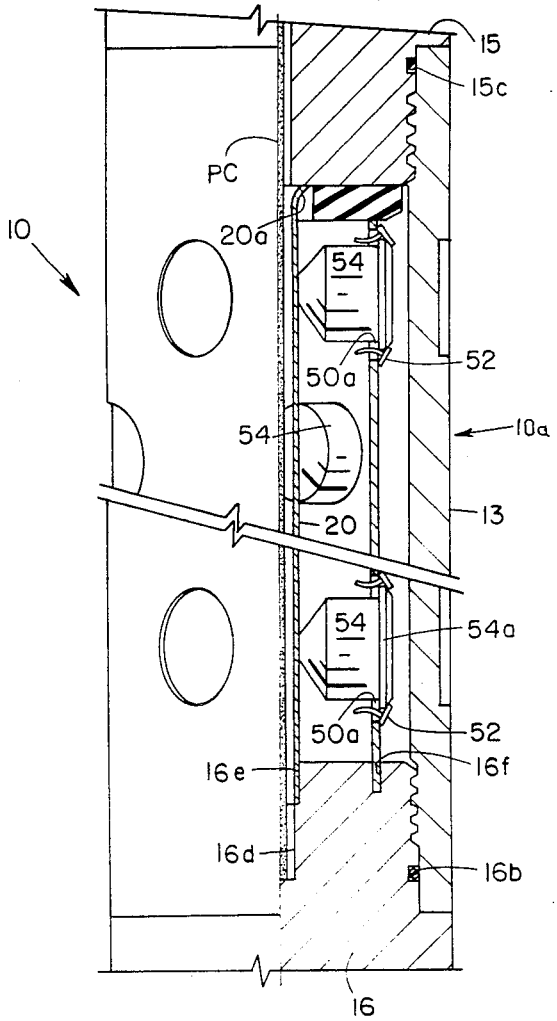

Referring now to the modification of FIGS. 3A, 3B and 4, the only substantial difference is the employment of a polygonal tubular carrier 50 which is mounted within the interior of each tubular housing section 15 and mounts the shaped charge containers 54. The polygonal carrier 50 may be formed from extruded aluminum, and the shaped charge containers 54 may be provided with enlarged head portions 54*a* which abut against the side walls of apertures 50*a* provided in the wall of the polygonal carrier 50. The shaped charge containers 54 are then secured in the apertures 50*a* by securing means, such as blind rivets 52 in the manner fully described and illustrated in co-pending application Ser. No. 432,481, filed Oct. 4, 1982, and assigned to the Assignee of this application. The polygonal carriers 50 are positioned in concentric relationship with respect to the axis of the tubular housing 13 by having their bottom ends inserted in a polygonally shaped groove 15*f* formed in the top surface of each hollow nipple 15, and in groove 16*f* of plug 16 for the bottom gun section.

Figure 2:
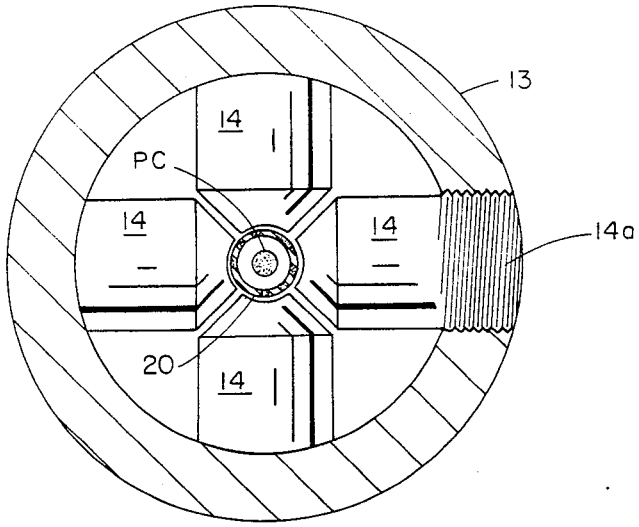
FIG. 2 is a sectional view taken on the plane 2—2 of FIG. 1A.

The lengths 20 of fusible tubing are inserted within each perforating gun section in abutting relationship with respect to the inner ends of the shaped charge containers 54. Thus, the gun is assembled and armed in the same manner as described in connection with the modification of FIGS. 1A, 1B and 2 through the successive assembly of the gun sections by threadably engaging the various tubular housings 13 with the connecting hollow nipples 15. Obviously, the polygonal carrier 50 with the shaped charge containers 54 mounted thereon, and the guide tube 20 are inserted within each housing section 13 as the assembly progresses. When the assembly is complete, all of the assembly is lowered into the well so that all of the shaped charges 54 are disposed below the well surface, and a continuous length of primer cord PC is inserted through the aligned bores of the booster sub 12, the fusible guide tubing lengths 20, and the hollow nipples 15. The ignition of the top end of the continuous length of primer cord PC is effected by a booster charge 22 contained within a plastic connecting element 25 through ignition of a primer charge 30 in the manner heretofore described.

Figure 5:
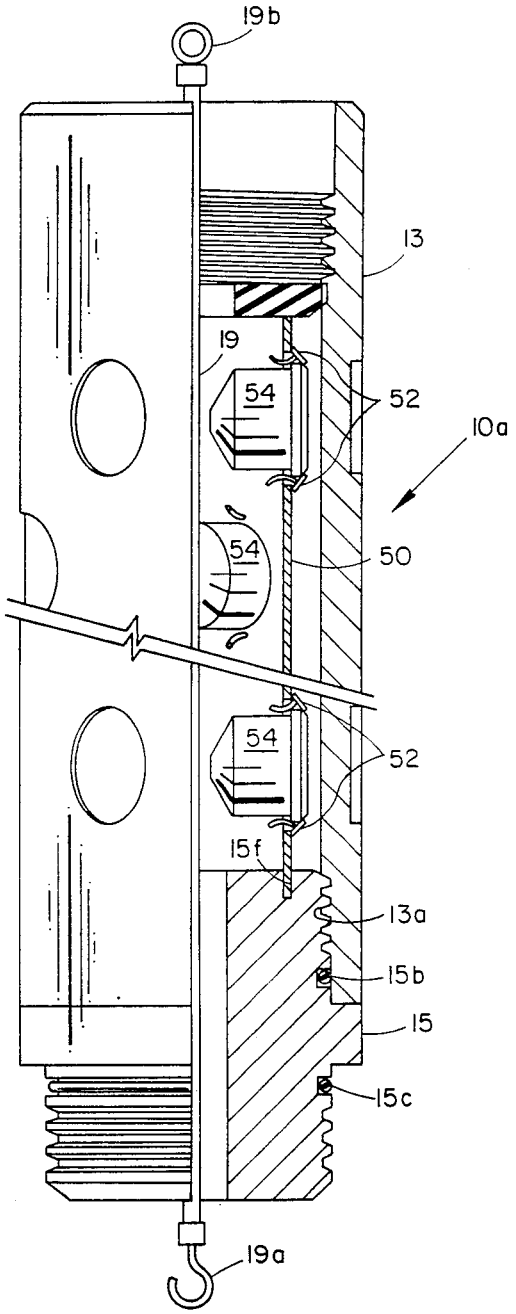
FIG. 5 is a vertical sectional view of an individual gun section utilized in a modification of this invention.
Figure 6A:
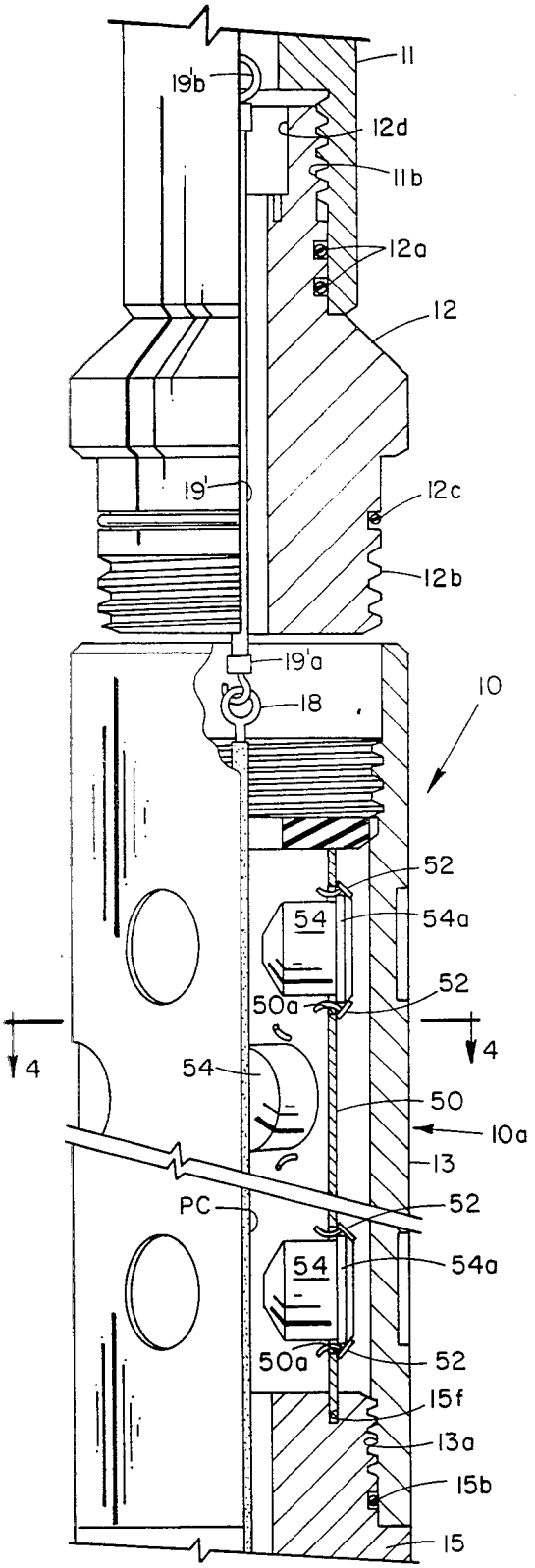
FIGS. 6A and 6B collectively represent a schematic vertical sectional view of a partially assembled perforating gun utilizing gun sections in accordance with FIG. 5.
Figure 6B:
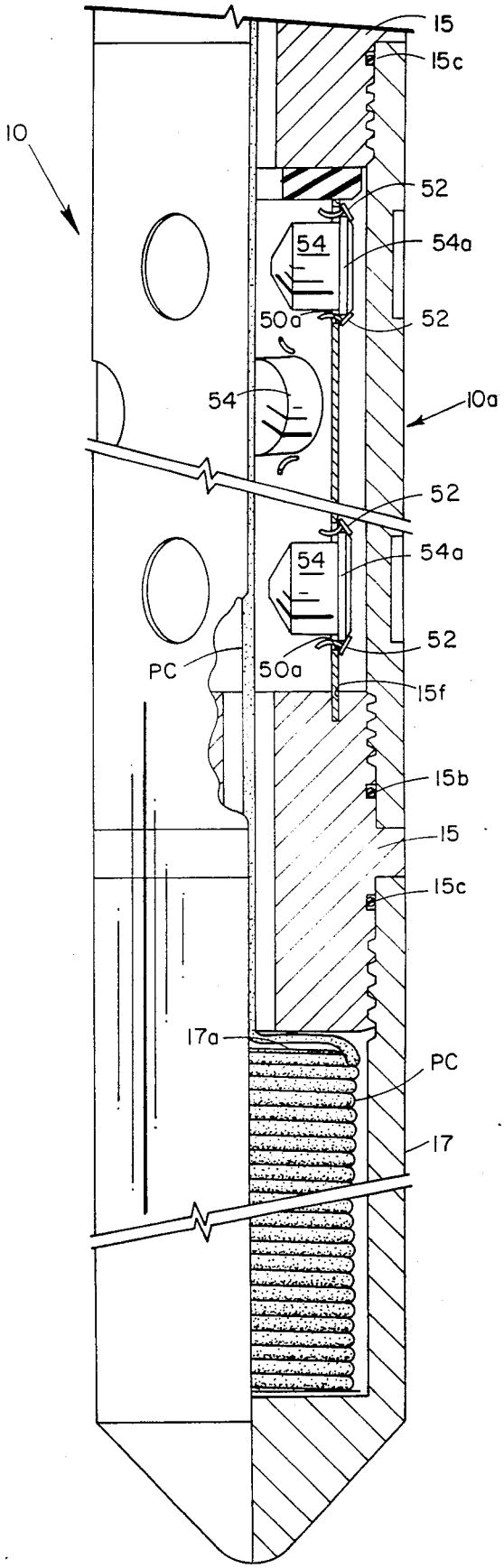
Figure 7:
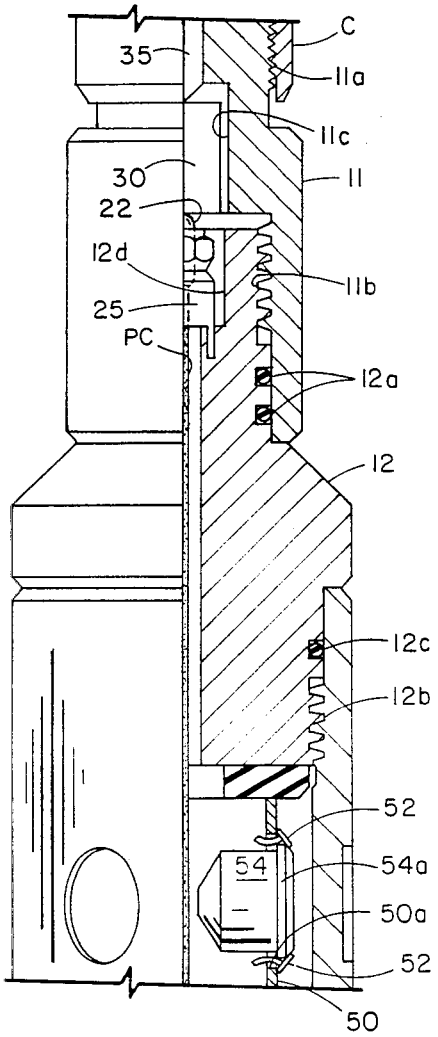
FIG. 7 is a vertical sectional view of the top portions of the gun of FIG. 6A after completion of assembly.

Referring now to FIGS. 5, 6A, 6B, and 7, there is shown a further modification of this invention wherein a continuous length of primer cord is employed to effect the firing of the plurality of shaped charges disposed in a multisection perforating gun. Referring first to FIGS. 6A and 6B, wherein similar numerals represent similar parts utilized in the modifications heretofore described, a reel containing housing 17 is threadably connected to the lowermost nipple 15 of the gun in place of the plug 16 employed in the previously described modifications. Reel housing 17 contains a reel 17*a* upon which is coiled a sufficient length of primer cord PC to extend entirely through the assembled gun sections. Alternatively, the primer cord PC may be wound in a self-supporting reel configuration and disposed in reel housing 17. A detachable connector, such as an eye connection 18 (FIG. 6A), is crimped to the free end of the primer cord on the reel 17*a*. This permits the end of the primer cord to be engaged by a hook 19*a* provided on a cable 19 (FIG. 5) which traverses the gun section 10*a* immediately above the reel containing housing 17 and terminates in its upper end in an eye connection 19*b*. Cable 19 may be formed of any tensionally adequate material, such as rope, wire or plastic, and preferably, is preassembled at the factory in the individual gun section 10*a* as shown in FIG. 5.

The total assembly operation involving a large number of gun sections 10*a* then proceeds by first engaging the hook portion 19*a* of the pull cable 19 with the eye connector 18*a* on the end of the primer cord then threadably engaging the gun section 10*a* with reel housing 17 and then pulling the primer cord PC through the section 10*a* which is to be asembled to the reel containing house 17. The pull cable 19 may then be removed and the eye hook end 18 of the primer cord PC secured against falling back into the gun section by any convenient means.

The next gun section 10*a* to be assembled is then positioned above the previously assembled gun section and the hook portion 19*a* of the pull cable 19 for that next gun section is engaged with the eye connector 18 on the end of the primer cord PC. The next gun section is threadably assembled to the threads of the connecting nipple 15 provided at the top of the first assembled gun section. The primer cord PC is pulled upwardly through the next gun section 10*a*, following which the pulling cable 19 for that gun section is removed. The assembly proceeds in like manner until the required number of gun sections 10*a* have been assembled, following which assembly to the firing mechanism is accomplished through the simple expedient of again using a pull cable 19' extending through the bore of the firing head 11 and the booster containing sub 12 so that the primer cord connector 18 may be engaged by the hook portion 19'*a* and pulled up into the booster chamber 12*d* where it is secured to a booster charge connector 25 (FIG. 7) in the manner previously described in connection with the modification of of FIGS. 1A and 1B.

If it is desired to fire from the bottom of the gun upwardly, then a length of flame-conducting tubing or fusible cord is contiguously secured to the primer cord PC in any of the manners described in my co-pending application Ser. No. 743,580, filed concurrently herewith and assigned to the Assignee of this application. In such case, no booster charge is attached to the upper end of the primer cord PC but instead, the primer cord PC is termimated below the booster chamber 12*d* so as to not be detonated by the primer charge 30, while the end of the flame-conducting tubing is secured in a higher position so as to be ignited by the primer charge 30. A conventional booster charge of the type known as a DDT charge, which are sold under the trademark "PRIMADETS" by the Ensign Bickford Company, is secured to the bottom ends of both the flame-conducting detonating tubing and the primer cord PC. Primer cord PC and the flame-conducting tubing are, of course, both wound upon the reel 17*a* and concurrently pulled upwardly through the entire assembly of gun section in the manner heretofore described.

In all modifications in this invention, it is preferred to use a continuous length of primer cord, but this may not always be possible. Thus, shorter lengths of primer cord than required may be crimped together to form a continuous length. If the total gun assembly is extremely long, it may be desirable to intersperse booster charges along the length of the primer cord to assure that the detonation shock wave of the primer cord will be transmitted its entire length. The essential feature is that the entire primer cord assemblage, either with or without booster charges, and with or without a flame-conducting tubing, is inserted within the gun as an entity during the normal assemblage of the gun sections at the well site.

Those skilled in the art will recognize that the aforedescribed methods and apparatuses permit the assembly of a multisection perforating gun of any desired length without exposing the personnel accomplishing the assembly to any significant risk of premature explosion of the shaped charges involved in the assembly. Moreover, since only a single booster charge is employed at the top end of the continuous primer cord, the assembly of a single detonatable element in the gun minimizes by a factor of one hundred the risk of injury previously associated with the assembly of a number of such booster charges in a multisection gun. If an accident does occur, the shaped charges are disposed below the well surface so that an inadvertent ignition of such shaped charges will not result in injury to personnel at the well surface.

Of equal importance is the fact that utilization of a continuous length of primer cord eliminates the problems heretofore repeatedly encountered with the failure of ignition of successive lengths of primer cord employed in prior art constructions, with reliance being placed on booster charges at each end of the primer cords to effect the transmission of the ignition energy from the primer cord of one gun section to the next gun section. The method and apparatus of this invention substantially eliminates the necessity for ever having to withdraw the perforating gun from the well due to a failure of the continuous primer cord to ignite all of the shaped charges involved in the perforating gun.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A perforating gun for a subterranean well comprising: a plurality of gun sections connected in axially stacked relationship, each gun section comprising a plurality of shaped charge containers having primer ends thereon; tubular carrier means for mounting said containers in spaced relationship with the primer ends of said shaped charge containers disposed inwardly to define an axial passage through each gun section; a fusible tube extending through each said axial passage; primer cord means extending through said fusible tube; and means for detonating one end of said primer cord means, thereby firing all said shaped charges.

2. A perforating gun in accordance with claim 1 further comprising a reel housing secured to the lowermost one of said gun sections; said housing containing said primer cord means in coiled form, and detachable connector means on a free end of said primer cord means for connection with pulling means for pulling said continuous primer cord means successively through said axial passages of said gun sections.

3. A perforating gun in accordance with claim 2 wherein each said gun section originally included a pull cord traversing said axial passage and having end portions projecting out of the gun section; and detachable connecting means on the lower one of said projecting ends for pulling said continuous primer cord through said axial passage of the respective gun section.

4. A perforating gun in accordance with claim 1, 2 or 3 wherein a continuous flame-transmitting tube is secured in side-by-side relation to said continuous primer cord, and said means for detonating one end of said continuous primer cord comprises a detonatable primer charge at the top of the gun operatively connected to ignite only the top end of said flame-transmitting tube; and a booster charge interconnected between the bottom ends of said flame-transmitting tube and said continuous primer cord, thereby detonating said primer cord from the bottom upwardly through said axially stacked gun sections.

5. A perforating gun for a subterranean well comprising: a plurality of shaped charge containers, each container having a primer containing end; carrier means for mounting said containers in vertically and angularly spaced relation; fusible tube means defining a continuous axial passage adjacent said primer ends of said shaped charge containers; a continuous length of primer cord extending through said continuous axial passage; and means for detonating one end of said primer cord, thereby melting said fusible tube means and firing said shaped charges.

6. The perforating gun of claim 5 wherein said fusible tube means comprises aluminum.

7. The perforating gun of claim 5 wherein said fusible tube means comprises a relatively rigid, fusible thermoplastic.

8. A perforating gun for a subterranean well comprising: a plurality of shaped charge containers, each container having a primer containing end; carrier means for mounting said containers in vertically and angularly spaced relation with all said primer containing ends disposed substantially the same radial distance from the well axis; fusible tube means coaxially located in said carrier means and defining a continuous axial passage adjacent said primer ends of said shaped charge containers; a continuous length of primer cord extending through said continuous axial passage; and means for detonating one end of said primer cord, thereby melting said fusible tube means and firing said shaped charges.

9. The perforating gun of claim 8 wherein said fusible tube means comprises aluminum.

10. The perforating gun of claim 8 wherein said fusible tube means comprises a relatively rigid, fusible thermoplastic.

11. A multisection perforating gun for a subterranean well comprising, for each section: a tubular carrier, a plurality of shaped charge containers mounted in the wall of said tubular carrier, a relatively rigid tube of fusible material coaxially disposed in said tubular carrier and having its outer wall disposed in close proximity to the primer ends of said shaped charge containers; means including a plurality of hollow nipples for respectively connecting the tubular carriers in axially stacked relationship; a firing mechanism including a primer charge mounted on one end of the axially stacked tubular carriers; and a continuous primer cord extending from said primer charge through the axially aligned bores of said tubular carriers and said hollow nipples, whereby detonation of said primer charge ignites said primer cord, melts said fusible tube and discharges the shaped charges disposed in said shaped charge containers.

12. The perforating gun of claim 11 wherein said tubes of fusible material comprise aluminum members.

13. The perforating gun of claim 11 wherein said tubes of fusible material comprise thermoplastic members.

* * * * *